United States Patent [19]

Cruce

[11] Patent Number: 4,697,345

[45] Date of Patent: Oct. 6, 1987

[54] APPARATUS FOR SEGMENTING EDIBLE PEELS OF FRUIT AND THE LIKE

[76] Inventor: Evie C. Cruce, 2647 Crossgate Trail, Montgomery, Ala. 36117

[21] Appl. No.: 808,285

[22] Filed: Dec. 12, 1985

[51] Int. Cl.[4] ..... B26B 3/00

[52] U.S. Cl. ..... 30/315; 30/123.5; 30/358

[58] Field of Search ..... 30/113.3, 114, 115, 30/116, 117, 120.1, 120.2, 120.3, 120.4, 120.5, 123.5, 358, 361, 366, 368

[56] References Cited

U.S. PATENT DOCUMENTS 1,482,736 2/1924 Catsules ..... 30/315
1,517,931 12/1924 Wible ..... 30/358
2,618,852 11/1952 Clough ..... 30/305 X
2,729,254 1/1956 McLaughlin ..... 30/121.1

FOREIGN PATENT DOCUMENTS 13187 of 1905 United Kingdom ..... 30/315

*Primary Examiner*—E. R. Kazenske
*Assistant Examiner*—Michael D. Folkerts

[57] ABSTRACT

Apparatus for segmenting the edible peel of a fruit or the like utilizes a flexible resilient base member which is deformable to conform to the surface of the fruit and which carries on one side thereof a plurality of interconnected blades which define a number of small enclosed areas. Pressure applied to the base member is transferred to the blades which penetrate the peel of the fruit and segment the peel into regions corresponding to the enclosed areas.

2 Claims, 4 Drawing Figures

FIG. 1
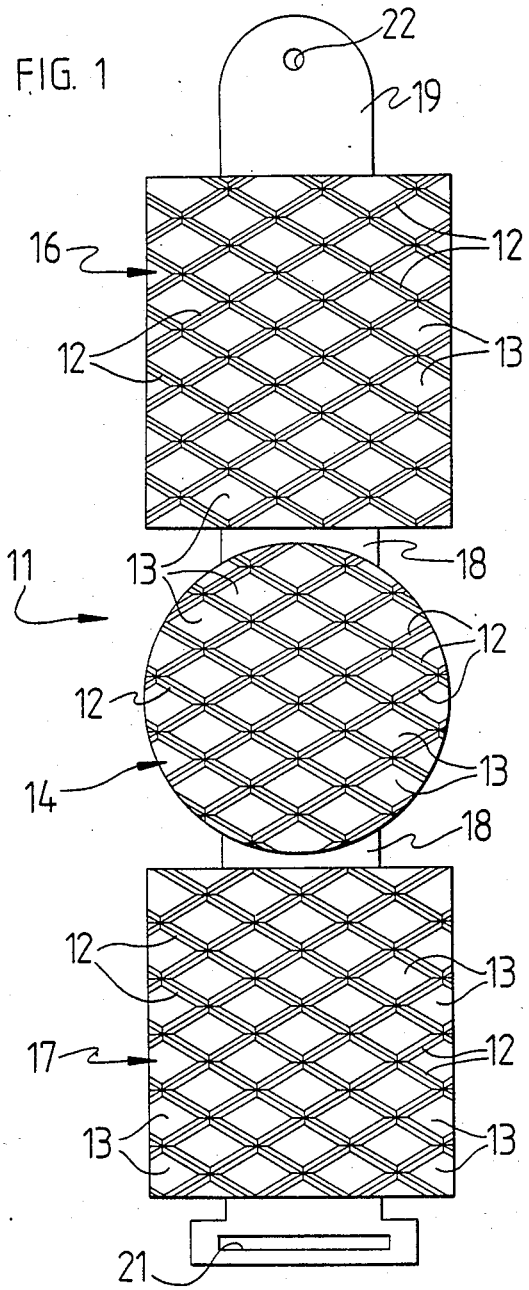
FIG. 2
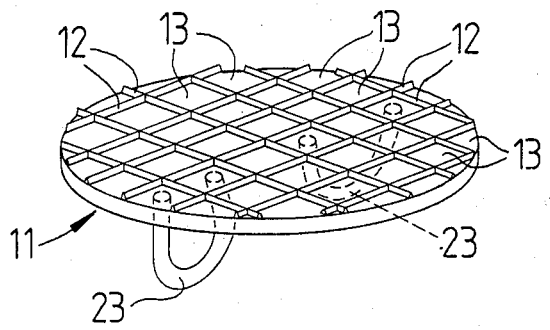
FIG. 4
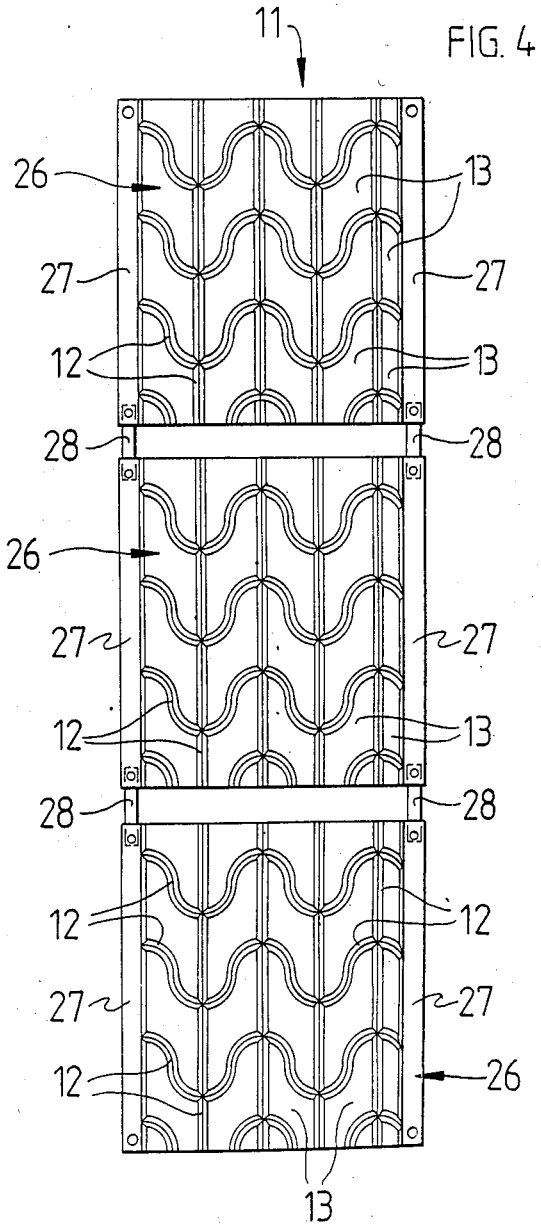
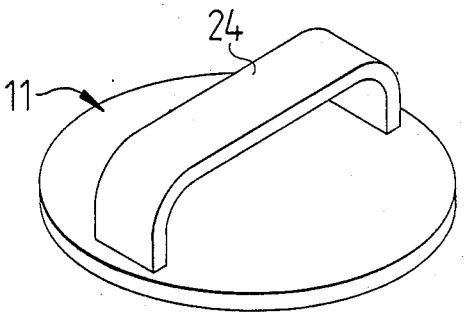
FIG. 3

APPARATUS FOR SEGMENTING EDIBLE PEELS OF FRUIT AND THE LIKE

BACKGROUND OF THE INVENTION

The present invention relates to food preparation and more particularly to an apparatus for segmenting the edible peel of a fruit without removing the peel from the fruit.

The peel or skin of a fruit, although edible, may often present a problem to people who wish to eat the fruit. For example, some denture wearers and most small children have difficulty biting through and chewing the peel of such fruits such as apples and pears. Furthermore, many people, particularly elderly people, are easily choked by large peel segments. While it is a simple matter for most adults to peel the fruit and then eat it, such is not the case for children and soxe adults with various disorders, such as arthritis, in their hands. Also the peel can be a source of fiber content and possible nutrients which is normally discarded when the fruit is peeled.

SUMMARY OF THE INVENTION

It is an object of the invention to segment the peel of a fruit to facilitate eating the fruit in an unpeeled state.

Another object of the invention is to enable persons to easily chew unpeeled fruit, thereby increasing their fiber intake.

These and other objects are advantageously accomplished in my invention through the use of a flexible base member which may be configured in a variety of shapes, but which is deformable under manual pressure to conform to the shape of a fruit. One side of the base member has attached thereto a plurality of intersecting blades which define a plurality of small enclosed areas. The blades are sufficiently rigid to to penetrate the skin or peel of the fruit thereby segmenting the peel into small pieces corresponding to the enclosed areas, yet the blades are flexible longitudinally so as to move with the base member as it is urged into conformity with the surface of the fruit.

BRIEF DESCRIPTION OF THE DRAWINGS

Apparatus embodying features of my invention are illustrated in the accompanying drawings which form a portion of this application and wherein:

FIG. 1 is a plan view of the invention wherein the base member includes an intermediate portion and two flanking portions;

FIG. 2 is a perspective view of the invention wherein the base member is round and has finger loops attached thereto;

FIG. 3 is a perspective view showing another modification wherein the back side of the embodiment depicted in FIG. 2 has a hand strap attached thereto instead of finger loops; and, FIG. 4 is a plan view showing a further embodiment wherein the base member is formed from a plurality of similar, interconnected portions.

DESCRIPTION OF A PREFERRED EMBODIMENT

Referring to FIG. 1, my invention utilizes a base member 11 which is made from a flexible somewhat resilient material such as plastic or other suitable elastomeric material. The base member 11 may be formed in a number of configurations as indicated in the drawings;

however the base member is a substantially planar member in each embodiment. Consequently the base member must be made of a material that is deformable to conform to the surface of a fruit yet elastic so that it returns to its original shape when disengaged from the fruit.

Affixed to the base member 11 or formed integrally therewith is a plurality of intersecting outwardly projecting blades 12 which extend normal to the surface of its base member 11. The blades 12 enclose small areas 13 on the surface of the base member 11 and extend outwardly from the surface a sufficient distance to penetrate the skin of a fruit. The blades 12 may be made of hard rubber or a suitable material which will be sufficiently rigid to penetrate the peel yet flexible longitudinally to conform to the surface of its base member 11 as it is urged about the fruit. Inasmuch as the blades 12 define the areas 13, it will be seen that urging the base member 11 into conformity with the fruit causes the blades 12 to segment the peel of the fruit in accordance with the size of the individual areas 13. These enclosed areas 13 may be of various sizes; however as the area becomes larger the beneficial results of the invention are diminished. The base member 11 must be sufficiently resilient to transfer an external force to the blades 12. Preferably the force will be somewhat uniformly applied to the blades 12 proximal the area of application of the force.

The embodiment shown in FIG. 1 utilizes a base member 11 which has an intermediate portion 14 and a pair of flanking portions 16 and 17 which are flexibly attached to or formed integrally therewith as at 18. One flanking portion 16 may be provided with a tongue 19 and the other with a slot 21 through which the tongue 19 may be inserted. An aperture 22 in the tongue 19 permits the apparatus to be stored by hanging it on a hook or like member. The flanking portions 16 and 17 each have a discrete set of blades 12 thereon. To use the apparatus, a fruit, such as an apple, is placed on the intermediate portion 14 and the flanking portions 16 and 17 are raised into engagement with the sides and top of the fruit. Manual pressure is applied to the outer surface of the apparatus causing the blades 12 to penetrate and segment the peel. The fruit may then be rotated and the procedure repeated until the desired segmentation is achieved.

The embodiments shown in FIGS. 2 and 3 each use a base member 11 which may be round or oval in shape and which has finger loops 23 and a hand strap 24, respectively, attached to the backs thereof. The user may thus hold the fruit in one hand and hold the apparatus with the other hand. The fruit is then urged against the apparatus or the apparatus is urged against the fruit to segment the peel.

The embodiment shown in FIG. 4 utilizes a plurality of similar portions 26 such as rectangular portions which each carry a discrete set of blades 12. Each portion 26 has a pair of lateral extensions 27 which are connected near each end thereof to the lateral extensions 27 of another portion 26 by flexible fasteners 28 thereby forming a chain-like base member 11. The chain-like base member may be wrapped around the fruit and manual pressure applied to segment the peel.

My apparatus may also be used to segment the peel of fruits prior to cooking the fruit, thus making the hot cooked fruit easier to eat. The invention may be also advantageously applied to the skin of tubers such as potatoes to segment their skin prior to baking. While I have indicated that manual pressure is to be used with my apparatus, it is to be understood that this refers to the amount of force required to cause the segmentation rather than the particular method of application inasmuch as it is apparent that my apparatus may be adapted for mechanical application of force.

While I have shown my invention in several forms, it will be obvious to those skilled in the art that it is not so limited, but is susceptible of various other changes and modifications without departing from the spirit thereof.

What I claim is:

1. An apparatus for segmenting the edible peel of a fruit and the like without removing the peel from said fruit comprising: a flexible base member which may be urged into conformity with the surface of said fruit, said base member comprising an intermediate portion and two flanking portions, each said flanking portion being located on opposite sides of said intermediate portion and aligned on a common longitudinal axis, each portion of said base member supporting a plurality of discrete intersecting blades normal to a surface thereof and extending a distance sufficient to penetrate only said peel and defining a plurality of small interconnected enclosed areas, and flexible coupling means connecting each said flanking portion to said intermediate portion.

2. An apparatus as defined in claim 1 wherein said intermediate portion and said flanking portions are rectangular.

* * * * *